US009297517B2

(12) United States Patent
Holder et al.

(10) Patent No.: US 9,297,517 B2
(45) Date of Patent: Mar. 29, 2016

(54) LED DEVICES FOR OFFSET WIDE BEAM GENERATION

(71) Applicant: Cooper Technologies Company, Houston, TX (US)

(72) Inventors: Ronald G. Holder, Laguna Niguel, CA (US); Greg Rhoads, Irvine, CA (US)

(73) Assignee: Cooper Technologies Company, Houston, TX (US)

( * ) Notice: Subject to any disclaimer, the term of this patent is extended or adjusted under 35 U.S.C. 154(b) by 46 days.

(21) Appl. No.: 13/908,663

(22) Filed: Jun. 3, 2013

(65) Prior Publication Data

US 2013/0258665 A1 Oct. 3, 2013

Related U.S. Application Data

(63) Continuation of application No. 13/418,896, filed on Mar. 13, 2012, now Pat. No. 8,454,205, which is a continuation of application No. 12/945,515, filed on Nov. 12, 2010, now Pat. No. 8,132,942, which is a (Continued)

(51) Int. Cl.
*F21V 3/00* (2015.01)
*F21V 5/00* (2015.01)
(Continued)

(52) U.S. Cl.
CPC . *F21V 13/02* (2013.01); *F21V 5/04* (2013.01); *F21V 7/0066* (2013.01); *F21V 13/04* (2013.01);
(Continued)

(58) Field of Classification Search
CPC ..... F21V 5/002; F21V 5/004; F21V 5/007; F21V 5/04; F21V 7/0066; F21V 13/00; F21V 13/02; F21V 13/04; F21K 9/00; F21W 2131/103; Y10S 362/80
USPC ..... 362/240, 245, 249.02, 311.02, 327–329
See application file for complete search history.

(56) References Cited

U.S. PATENT DOCUMENTS 1,758,977 A 5/1930 Rolph
2,254,961 A 9/1941 Harris
(Continued)

FOREIGN PATENT DOCUMENTS

CN 2750186 1/2006
CN 1737418 2/2006
(Continued)

OTHER PUBLICATIONS

Streetworks fixture from Cooper Lighting and 2 IES files, Aug. 14, 2001.
(Continued)

*Primary Examiner* — Jason M Han
(74) *Attorney, Agent, or Firm* — King & Spalding LLP

(57) ABSTRACT

A light source is combined with an optic and a reflector. Light incident onto to the reflector is reflected with a single reflection. The reflector occupies a portion of a solid angle around the light source to the exclusion of the optic at least with respect to any optical function. The reflector directly receives a second portion of light. The optic occupies substantially all of the remaining portion of the predetermined solid angle to directly receive a first portion of light from the light source. A reflected beam from the reflector is reflected into a predetermined reflection pattern. The inner and/or outer surface of the optic is shaped to refract or direct light which is directly transmitted into the optic from the light source from a first portion of light and/or reflected into the optic from the reflector from the reflected beam into a predetermined beam.

19 Claims, 10 Drawing Sheets

Related U.S. Application Data continuation of application No. 12/541,060, filed on Aug. 13, 2009, now Pat. No. 7,854,536.

(60) Provisional application No. 61/122,339, filed on Dec. 12, 2008, provisional application No. 61/088,812, filed on Aug. 14, 2008.

(51) Int. Cl.

| | |
|---|---|
| ***F21V 13/02*** | (2006.01) |
| ***F21V 5/04*** | (2006.01) |
| ***F21V 13/04*** | (2006.01) |
| ***F21V 17/10*** | (2006.01) |
| ***F21V 17/16*** | (2006.01) |
| ***F21V 7/00*** | (2006.01) |
| *F21K 99/00* | (2010.01) |
| *F21W 131/103* | (2006.01) |
| *F21Y 101/02* | (2006.01) |

(52) U.S. Cl.

CPC ..... *F21V 17/101* (2013.01); *F21V 17/164* (2013.01); *F21K 9/00* (2013.01); *F21K 9/90* (2013.01); *F21W 2131/103* (2013.01); *F21Y 2101/02* (2013.01); *Y10S 362/80* (2013.01)

(56) References Cited

U.S. PATENT DOCUMENTS

| | | | |
|---|---|---|---|
| 2,394,992 | A | 2/1946 | Franck |
| 2,818,500 | A | 12/1957 | Franck |
| 2,908,197 | A | 10/1959 | Wells et al. |
| 3,278,743 | A | 10/1966 | Franck |
| 3,596,136 | A | 7/1971 | Fischer |
| 3,647,148 | A | 3/1972 | Wince |
| 3,927,290 | A | 12/1975 | Denley |
| 4,345,308 | A | 8/1982 | Mouyard et al. |
| 4,460,945 | A | 7/1984 | Chan |
| 4,729,076 | A | 3/1988 | Masami |
| 4,734,836 | A | 3/1988 | Negishi |
| 4,860,177 | A | 8/1989 | Simms |
| 4,907,044 | A | 3/1990 | Schellhorn et al. |
| 4,941,072 | A | 7/1990 | Yasumoto |
| 5,404,869 | A | 4/1995 | Parkyn |
| 5,424,931 | A | 6/1995 | Wheeler |
| 5,636,057 | A | 6/1997 | Dick et al. |
| 5,782,555 | A | 7/1998 | Hochstein |
| 5,857,767 | A | 1/1999 | Hochstein |
| 5,924,788 | A | 7/1999 | Parkyn, Jr. |
| 5,926,320 | A | 7/1999 | Parkyn |
| 5,939,996 | A | 8/1999 | Kniveton et al. |
| 6,045,240 | A | 4/2000 | Hochstein |
| 6,050,707 | A | 4/2000 | Kondo et al. |
| 6,102,558 | A | 8/2000 | Farnoux |
| 6,227,684 | B1 | 5/2001 | Wijbenga |
| 6,227,685 | B1 | 5/2001 | McDermott |
| 6,273,596 | B1 | 8/2001 | Parkyn, Jr. |
| 6,341,466 | B1 | 1/2002 | Kehoe et al. |
| 6,345,800 | B1 | 2/2002 | Herst et al. |
| 6,441,558 | B1 | 8/2002 | Muthu et al. |
| 6,461,008 | B1 | 10/2002 | Pederson |
| 6,502,956 | B1 | 1/2003 | Wu |
| 6,527,422 | B1 | 3/2003 | Hutchison |
| 6,536,923 | B1 | 3/2003 | Merz |
| 6,547,423 | B2 | 4/2003 | Marshall et al. |
| 6,560,038 | B1 | 5/2003 | Parkyn et al. |
| 6,582,103 | B1 | 6/2003 | Popovich et al. |
| 6,598,998 | B2 | 7/2003 | West et al. |
| 6,639,733 | B2 | 10/2003 | Minano |
| 6,784,357 | B1 | 8/2004 | Wang |
| 6,785,053 | B2 | 8/2004 | Savage, Jr. |
| 6,837,605 | B2 | 1/2005 | Reill |
| 6,850,001 | B2 | 2/2005 | Takekuma |
| 6,895,334 | B2 | 5/2005 | Yabe |
| 6,942,361 | B1 | 9/2005 | Kishimura et al. |
| 6,948,838 | B2 | 9/2005 | Kunstler |
| 6,965,715 | B2 | 11/2005 | Lei |
| 6,997,580 | B2 | 2/2006 | Wong |
| 7,070,310 | B2 | 7/2006 | Pond et al. |
| 7,073,931 | B2 | 7/2006 | Ishida |
| 7,090,370 | B2 | 8/2006 | Clark |
| 7,102,172 | B2 | 9/2006 | Lynch et al. |
| 7,104,672 | B2 | 9/2006 | Zhang |
| 7,153,015 | B2 | 12/2006 | Brukilacchio |
| 7,172,319 | B2 | 2/2007 | Holder |
| 7,181,378 | B2 | 2/2007 | Benifez |
| 7,204,627 | B2 | 4/2007 | Ishida |
| 7,237,936 | B1 | 7/2007 | Gibson |
| 7,278,761 | B2 | 10/2007 | Kuan |
| 7,281,820 | B2 | 10/2007 | Bayat et al. |
| 7,322,718 | B2 | 1/2008 | Setomoto et al. |
| D563,036 | S | 2/2008 | Miyairi et al. |
| 7,329,029 | B2 | 2/2008 | Chaves et al. |
| 7,329,030 | B1 | 2/2008 | Wang |
| 7,329,033 | B2 | 2/2008 | Glovatsky |
| 7,339,200 | B2 | 3/2008 | Amano et al. |
| 7,347,599 | B2 | 3/2008 | Minano et al. |
| 7,348,604 | B2 | 3/2008 | Matheson |
| 7,348,723 | B2 | 3/2008 | Yamaguchi et al. |
| 7,352,011 | B2 | 4/2008 | Smits et al. |
| 7,374,322 | B2 | 5/2008 | Steen et al. |
| 7,410,275 | B2 | 8/2008 | Sommers et al. |
| D577,852 | S | 9/2008 | Miyairi et al. |
| 7,460,985 | B2 | 12/2008 | Benitez |
| 7,461,948 | B2 | 12/2008 | Van Voorst Vader et al. |
| 7,507,001 | B2 | 3/2009 | Kit |
| 7,513,639 | B2 | 4/2009 | Wang |
| 7,553,051 | B2 | 6/2009 | Brass et al. |
| 7,569,802 | B1 | 8/2009 | Mullins |
| 7,572,027 | B2 | 8/2009 | Zampini, II |
| 7,572,654 | B2 | 8/2009 | Chang |
| 7,575,354 | B2 | 8/2009 | Woodward |
| 7,582,913 | B2 | 9/2009 | Huang et al. |
| 7,618,162 | B1 | 11/2009 | Parkyn et al. |
| 7,618,163 | B2 | 11/2009 | Wilcox |
| 7,625,102 | B2 | 12/2009 | Koike et al. |
| 7,637,633 | B2 | 12/2009 | Wong |
| 7,651,240 | B2 | 1/2010 | Bayat et al. |
| 7,674,018 | B2 | 3/2010 | Holder et al. |
| 7,775,679 | B2 | 8/2010 | Thrailkill et al. |
| 7,777,405 | B2 | 8/2010 | Steen et al. |
| 7,809,237 | B2 | 10/2010 | Pozdnyakov et al. |
| 7,817,909 | B2 | 10/2010 | Montgomery et al. |
| 7,841,750 | B2 | 11/2010 | Wilcox et al. |
| 7,854,536 | B2 | 12/2010 | Holder |
| 7,891,835 | B2 * | 2/2011 | Wilcox ..... 362/245 |
| 7,942,559 | B2 | 5/2011 | Holder |
| 7,972,035 | B2 | 7/2011 | Boyer |
| 7,972,036 | B1 | 7/2011 | Schach et al. |
| 7,993,036 | B2 | 8/2011 | Holder et al. |
| 8,007,140 | B2 | 8/2011 | Zhang et al. |
| 8,025,428 | B2 | 9/2011 | Duguay et al. |
| 8,210,722 | B2 | 7/2012 | Holder et al. |
| 8,382,338 | B2 | 2/2013 | Lee |
| 8,414,161 | B2 | 4/2013 | Holder et al. |
| 2002/0034081 | A1 | 3/2002 | Serizawa |
| 2002/0196623 | A1 | 12/2002 | Yen |
| 2003/0067787 | A1 | 4/2003 | Serizawa |
| 2003/0099115 | A1 | 5/2003 | Reill |
| 2004/0004828 | A1 | 1/2004 | Chernick |
| 2004/0037076 | A1 | 2/2004 | Katoh et al. |
| 2004/0070855 | A1 | 4/2004 | Benitez et al. |
| 2004/0105171 | A1 | 6/2004 | Minano et al. |
| 2004/0105261 | A1 | 6/2004 | Ducharme |
| 2004/0105264 | A1 | 6/2004 | Spero |
| 2004/0189933 | A1 | 9/2004 | Sun et al. |
| 2004/0207999 | A1 | 10/2004 | Suehiro |
| 2004/0218388 | A1 | 11/2004 | Suzuki |
| 2004/0222947 | A1 | 11/2004 | Newton et al. |
| 2004/0228127 | A1 | 11/2004 | Squicciarini |
| 2005/0073849 | A1 | 4/2005 | Rhoads et al. |
| 2005/0207165 | A1 | 9/2005 | Shimizu et al. |
| 2006/0034082 | A1 | 2/2006 | Park |
| 2006/0039143 | A1 | 2/2006 | Katoh |

(56) References Cited

U.S. PATENT DOCUMENTS

| | | | | |
|---|---|---|---|---|
| 2006/0081863 | A1 | 4/2006 | Kim et al. | |
| 2006/0083003 | A1 | 4/2006 | Kim et al. | |
| 2006/0138437 | A1 | 6/2006 | Huang et al. | |
| 2006/0238884 | A1 | 10/2006 | Jang | |
| 2006/0245083 | A1 | 11/2006 | Chou et al. | |
| 2006/0250803 | A1 | 11/2006 | Chen | |
| 2006/0255353 | A1 | 11/2006 | Taskar | |
| 2006/0285311 | A1 | 12/2006 | Chang | |
| 2007/0019415 | A1 | 1/2007 | Leblanc | |
| 2007/0019416 | A1 | 1/2007 | Han | |
| 2007/0058369 | A1 | 3/2007 | Parkyn et al. | |
| 2007/0063210 | A1 | 3/2007 | Chiu | |
| 2007/0066310 | A1 | 3/2007 | Haar | |
| 2007/0076414 | A1 | 4/2007 | Holder | |
| 2007/0081338 | A1 | 4/2007 | Kuan | |
| 2007/0081340 | A1 | 4/2007 | Chung et al. | |
| 2007/0091615 | A1 | 4/2007 | Hsieh et al. | |
| 2007/0183736 | A1 | 8/2007 | Pozdnyakov | |
| 2007/0201225 | A1 | 8/2007 | Holder | |
| 2007/0258214 | A1 | 11/2007 | Shen | |
| 2008/0013322 | A1 | 1/2008 | Ohkawa | |
| 2008/0019129 | A1 | 1/2008 | Wang | |
| 2008/0025044 | A1 | 1/2008 | Park et al. | |
| 2008/0043473 | A1 | 2/2008 | Matsui | |
| 2008/0055908 | A1 | 3/2008 | Wu | |
| 2008/0068799 | A1 | 3/2008 | Chan | |
| 2008/0080188 | A1 | 4/2008 | Wang | |
| 2008/0100773 | A1 | 5/2008 | Hwang | |
| 2008/0174996 | A1 | 7/2008 | Lu | |
| 2008/0239722 | A1 | 10/2008 | Wilcox | |
| 2008/0273327 | A1 | 11/2008 | Wilcox et al. | |
| 2009/0103308 | A1 * | 4/2009 | Xu et al. | 362/294 |
| 2009/0244895 | A1 | 10/2009 | Chen | |
| 2009/0262543 | A1 | 10/2009 | Ho | |
| 2010/0014290 | A1 | 1/2010 | Wilcox | |

FOREIGN PATENT DOCUMENTS

| | | |
|---|---|---|
| DE | 202006015981 | 1/2007 |
| EP | 1431653 | 6/2004 |
| EP | 1686630 | 8/2006 |
| GB | 718425 | 11/1954 |
| GB | 794670 | 5/1958 |
| GB | 815609 | 7/1959 |
| JP | 06-177424 | 6/1994 |
| JP | 11-154766 | 9/1997 |
| JP | 2001-517855 | 9/1998 |
| JP | 2005-062461 | 3/2005 |
| JP | 2009-021086 | 1/2009 |
| KR | 10-2006-0033572 | 4/2006 |
| KR | 10-2006-0071033 | 6/2006 |
| KR | 20070015738 | 2/2007 |
| KR | 20100015957 | 2/2010 |
| KR | 20100105388 | 9/2010 |
| WO | WO 96/24802 | 8/1996 |
| WO | WO 98/33007 | 7/1998 |
| WO | WO 03/044870 | 5/2003 |
| WO | WO 2004/068909 | 8/2004 |
| WO | WO 2005/041254 | 5/2005 |
| WO | WO 2005/057082 | 6/2005 |
| WO | WO 2005/093316 | 10/2005 |
| WO | WO 2007/100837 | 9/2007 |
| WO | WO 2008/144672 | 11/2008 |
| WO | WO 2010/019810 | 2/2010 |
| WO | WO 2011/098515 | 8/2011 |

OTHER PUBLICATIONS

Bisberg, *LED Magazine*, The 5mm. Package Versus the Power LED: Not a Light choice for the Luminaire Designer, pp. 19-21, Dec. 2005. *LED Magazine*, p. 36 Oct. 2005.

International Search Report and Written Opinion for WO 2010-019810 mailed Sep. 30, 2009.

International Search Report and Written Opinion for WO 2008-144672 mailed Nov. 27, 2008.

ISR and Written Opinion of ISA, PCT-US07-05118 mailed Mar. 11, 2008.

Bortz, "Optimal Design of a Non imaging Projection Lens for Use with an LED Light Source and a Rectangular Sheet." SPIE, pp. 130-138, vol. 4092, USA, published 2000.

International Search Report for PCT-US08-64168 mailed on Aug. 15, 2008.

Extended Search Report for EP Application No. 11006191 mailed Nov. 7, 2011.

Extended Search Report for EP Application No. 11006189 mailed Nov. 7, 2011.

Extended Search Report for EP Application No. 11006190 mailed Nov. 7, 2011.

Timinger, Dr. Andreas, *High Performance Optics Design for LEDs*, Strategies in Light, Feb. 2005.

Ries, Harold & Julius Muschaweck, *Tailored Freeform Optical Surfaces*, Optical Society of America, vol. 19, No. 3, Mar. 2002.

Extended Search Report for EP Application No. 08755907.6 mailed May 10, 2012.

Jolley L.B.W. et al., The Therory and Design of Illuminating Engineering Equipment, 1931.

Order; Case No. 11-CV-34-JPS; United States District Court Eastern District of Wisconsin; Jun. 8, 2012; (referencing U.S. Pat. Nos. 7,674,018 and 7,993,036).

International Search Report for PCT-US11-049388 mailed on Apr. 9, 2012.

Timinger, Andreas, Strategies Unlimited, "Charting New Directions in High-Brightness LED's ," Strategies in Light, Feb. 5-7, 2003.

Timinger, Andreas, "Optical Design for LED-Street Lamps," Conference Paper, Solid-State and Organic Lighting (SOLED), Karlsruhe, Germany, Jun. 21, 2010.

Order, Case No. 11-CV-34-JPS; United States District Court Eastern District of Wisconsin; filed Oct. 31, 2012.

LED's Magazine; High-Power LED's; multi-watt LED light Engines Offer Challenges and Opportunities; ledmagazine.com Oct. 2005.

Timinger, "Tailored Optical Surfaces Step up Illumination Design," Europhonics; Aug.-Sep. 2002 (color copy).

Plantiff Illumination Management Solutions, Inc.'s Initial Claim Construction Brief; Case No. 2:11-cv-00034 JPS; Apr. 5, 2012.

Ruud Lighting's Notice Pursuant to 35 U.S.C. §282; Civil Action 2:11-cv-00034-JPS; Oct. 12, 2012.

Expert Report of Dr. Roland Winston Regarding Invalidity, Civil Action 2:11-cv-00034-JPS; Jul. 17, 2012; Exhibits A-C.

Expert Report of Dr. Rick Mistrick; Validity of the '018 and '036 Patents; Civil Action 2:11-cv-00034-JPS; Aug. 17, 2012.

Expert Report of Dr. Rick Mistrick; Rebuttal of Dr. Roland Winston; Civil Action 2:11-cv-00034-JPS; Aug. 17, 2012.

Expert Report of Waqidi Falicoff; Civil Action 2:11-cv-00034-JPS; Jul. 17, 2012; Exhibits 1-24.

Aoyama, Y.; Yachi, T., "An LED Module Array System Designed for Streetlight Use," Energy 2030 Conference, 2008. Energy 2008. IEEE , vol., no., pp. 1-5, Nov. 17-18, 2008, doi: 10.1109/ENERGY.2008.4780996; URL: http://ieeexplore.ieee.org/stamp/stamp.jsp?tp=&arnumber=4780996&isnumber=4780986.

Petroski, J.; Norley, J.; Schober, J.; Reis, B.; Reynolds, R.A.; , "Conduction cooling of large LED array systems," Thermal and Thermomechanical Phenomena in Electronic Systems (ITherm), 2010 12th IEEE Intersociety Conference on , vol., no., pp. 1-10, Jun. 2-5, 2010; doi: 10.1109/ITHERM.2010.5501350; URL: http://ieeexplore.ieee.org/stamp/stamp.jsp?tp=&arnumber=5501350&isnumber=5501251.

Wankhede, M.; Khaire, V.; Goswami, A.; Mahajan, S.D.; , "Evaluation of Cooling Solutions for Outdoor Electronics," Electronics Packaging Technology Conference, 2007. EPTC 2007. 9th , vol., no., pp. 858-863, Dec. 10-12, 2007; doi: 10.1109/EPTC.2007.4469682; URL: http://ieeexplore.ieee.org/stamp/stamp.jsp?tp=&arnumber=4469682&isnumber=4469670.

International Search Report for PCT/US2012/026971; mailed Sep. 27, 2012.

European Search Report for application No. 09807313.3, mailed Sep. 25, 2014.

* cited by examiner

LED DEVICES FOR OFFSET WIDE BEAM GENERATION

RELATED APPLICATIONS

The present application claims priority under 35 U.S.C. §120 to U.S. patent application Ser. No. 13/418,896 filed on Mar. 13, 2012, (U.S. Pat. No. 8,454,205), which was a continuation of U.S. patent application Ser. No. 12/945,515 filed on Nov. 12, 2010, now U.S. Pat. No. 8,132,942 which was a continuation of U.S. patent application Ser. No. 12/541,060 filed on Aug. 13, 2009 now U.S. Pat. No. 7,854,536, which claims priority under 35 U.S.C. §119 to U.S. Provisional Patent Application Ser. No. 61/088,812, filed on Aug. 14, 2008 and U.S. Provisional Patent Application Ser. No. 61/122,339, filed on Dec. 12, 2008, each of which are incorporated herein by reference.

BACKGROUND OF THE INVENTION

1. Field of the Invention

The invention relates to the field of apparatus and methods for using LEDs or other light sources to generate predetermined offset wide profile two dimensional illumination patterns on a surface using a light source which has been optically modified to provide a corresponding wide profile beam or an array of multiple modified light sources.

2. Description of the Prior Art

Light emitting diodes (LEDs) are now being utilized for general lighting applications such as street lights, parking garage lighting, parking lots and many interior applications as well. LEDs have reached efficiency values per watt that outpace almost all traditional light sources, such as HID, compact fluorescent, incandescent, etc. However they are still very expensive in lumens per dollar compared to these traditional lamp sources. Therefore, optical, electronic and thermal efficiencies remain very important disciplines to realize products that are cost competitive with traditional lighting means. What is needed is an LED lighting solution with competitive or superior optical efficiency and hence increased energy efficiency as compared to these traditional lighting systems.

The initial investment cost of LED illumination is expensive when compared with traditional lighting means using cost per lumen as the metric. While this may change over time, this high cost places a premium on collection and distribution efficiency of the LED optical system. The more efficient the system, the better the cost-benefit comparison with traditional illumination means, such as incandescent, fluorescent and neon.

A traditional solution for generating broad beams with LEDs is to use one or more reflectors and/or lenses to collect and then spread the LED energy to a desired beam shape and to provide an angled array of such LEDs mounted on an apparatus that has the LEDs and optics pointing in various planes or angles. Street light illumination patterns conventionally are defined into five categories, Types I-V.

Another technique is to use a collimating lens and/or reflector and a sheet optic such as manufactured by Physical Devices Corporation to spread the energy into a desired beam. A reflector has a predetermined surface loss based on the metalizing technique utilized. Lenses which are not coated with anti-reflective coatings also have surface losses associated with them. The sheet material from Physical Devices Corporation has about an 8% loss.

Total internal reflectors (TIR) lenses, such as TIR 44 illustrated in FIG. 13, have been previously used to combine refracted light (e.g., ray 52 through crown 56 in FIG. 13) with totally internally reflected light (e.g., ray 50 reflected from surface 46 in FIG. 13). Some of the rays with TIR lens 44 are reflected from surface 46 and often several other internal surfaces in multiple reflections in TIR lens 44 to be directed across centerline 54 of TIR lens 44. However, only a portion of surface 46 is positioned at the correct angle with respect to the incident light from light source 1 to be totally reflected with the balance of the incident rays being refracted through surface 46 and sent in directions other than the desired beam direction through crown 56. Furthermore, even in the case of those rays which are nominally "totally internally reflected" from surface 46, the internal reflection, in actuality, is not total due to imperfections in the optical surface 46 and optical material out of which lens 44 is made so that a portion of these TIR rays are actually refracted through surface 46, such as depicted by ray 48. Moreover, any rays which are reflected by surface 46 must first be refracted by inner surface 58 of TIR lens 44, thereby further decreasing the fraction of light which ultimately reaches the intended beam since each refraction and reflection decreases the light intensity by as much as 8% depending on optical qualities and figure losses.

One example of prior art that comes close to a high efficiency system is the 'Side-emitter' device sold by Philips Lumileds Lighting Company. However, the 'side-emitter' is intended to create a beam with an almost 90 degree offset from the centerline of the radiation pattern of the LED in an intensity distribution that is azimuthally symmetric. It has internal losses of an estimated 15% and only provides azimuthally symmetric beam profiles, and not azimuthally asymmetric or azimuthally directed beams, i.e. the plots of the isocandela graph in three dimensions is a surface of revolution. Another Lumileds LED, commonly called a low dome, has a lens over the LED package to redirect the light, but it is to be noted that it has a singular distinct radius of curvature on the front surface and is not intended, nor is it suited for generating a smooth two dimensional patterned surface such as needed for illumination of a street or parking lot.

There are many systems designed that utilize armatures to hold optic 22 systems at angles to the ground to obtain spread beam patterns on the ground. Such armatures are often complex and/or difficult to assemble.

There are also several systems that slide the optics off center in one direction allowing the beam to move off center in the opposite direction of a centerline of the system in order to skew illumination patterns.

What is needed is a device that creates a wide angle beam, azimuthally asymmetric spread beam, that can be created with a method that allows the designer to achieve a smooth two dimensional surface at a distance, that can be an array of LEDs all mounted on or in the same plane, and which is not subject to the inherent disadvantages of the prior art.

BRIEF SUMMARY OF THE INVENTION

The illustrated embodiment of the invention is directed to an apparatus for illuminating a target surface with a predetermined pattern of light, such as a street light, illumination device for a traveled surface, interior lighting, vehicular, aircraft or marine lighting or any other lighting application. The apparatus includes a light source for generating light having a predetermined radiation pattern radiated into a predetermined solid angle. In an example embodiment of the invention the light source is a light emitting device (LED) or more generally any one of a plurality of LED packages now known or later devised. The apparatus includes a reflector onto which light from the light source is incident and which incident light is reflected from the reflector. The incident light may be reflected from the reflector with a single reflection to form a reflection pattern, at least with respect to incident light which is directly incident onto the reflector from the light source. An optic is provided which has an inner and outer surface, which is typically though not necessarily a refracting surface. The reflector occupies a portion of the predetermined solid angle around the light source to the exclusion of the optic at least with respect to any optical function. In other words, the optic and reflector are positioned around the light source, each to exclusively and directly receive light from the light source in its corresponding zone without the light first optically touching the other. The optic directly receives a first portion of light from the light source. The reflector occupies substantially all of the remaining portion of the predetermined solid angle to directly receive a second portion of light from the light source. Hence, substantially all of the light from the light source is directly incident on either the optic or the reflector. A reflected beam from the reflector includes substantially all of the second portion of light and is reflected into a predetermined reflection pattern. The inner and/or outer surface of the optic is shaped to refract and/or direct light which is directly transmitted into the optic from the light source from the first portion of light and/or reflected into the optic from the reflector from the reflected beam into a predetermined beam. The predetermined beam is incident on the target surface to form the predetermined composite pattern on the target surface.

In one embodiment the predetermined radiation pattern of the light source is substantially hemispherical, and the solid angle subtended by the reflector with respect to the light source is less than 27 steradians. In other words, the reflector only envelopes a portion of the hemisphere so that some light is radiated out of the apparatus without touching the reflector. Thus, it may be understood that the reflector is not formed as a complete surface of revolution like a conventional TIR optic or shell reflector, but will extend azimuthally only part way around the light source.

For example, the light source can be visualized as being positioned on an imaginary reference plane with the reflector subtending an azimuthal angle of various ranges from less than 360° to more than 0° in the imaginary reference plane relative to the light source, such as: less than 360°; approximately 315°±15° so that the predetermined pattern of light on the target surface has an azimuthal beam spread on the target surface of approximately 45°±15°; approximately 300°±15° so that the predetermined pattern of light on the target surface has an azimuthal beam spread on the target surface of approximately 60°±15°; approximately 270°±15° so that the predetermined pattern of light on the target surface has an azimuthal beam spread on the target surface of approximately 90°±15°; approximately 240°±15° so that the predetermined pattern of light on the target surface has an azimuthal beam spread on the target surface of approximately 120°±15°; approximately 180°±15° so that the predetermined pattern of light on the target surface has an azimuthal beam spread on the target surface of approximately 180°±15°; or approximately 90°±15° so that the predetermined pattern of light on the target surface has an azimuthal beam spread on the target surface of approximately 270°±15°.

In one embodiment the light source and reflector are positioned inside the optic. In another embodiment, the reflector and optic co-form an enclosure around the light source, each occupying its own portion of the enclosing shell. The reflector may be partially embedded in the optic and has a surface which replaces a portion of the inner surface of the optic.

In still another embodiment the optic is spatially configured with respect to the light source to directly receive substantially all of the light in the predetermined radiation pattern of the light source other than that portion directly incident on the reflector. That directly incident portion is reflected onto the inner surface of the optic, so that substantially all of the light is in the predetermined radiation pattern. In other words all of the radiated light which is not absorbed or misdirected as a result of imperfect optical properties of the optic and reflector is directed by the optic into the predetermined beam.

In one embodiment the light source, optic and reflector comprise a lighting device. In one embodiment a plurality of lighting devices are disposed on a carrier. The lighting devices are arranged on the carrier to form an array of lighting devices to additively produce a predetermined collective beam which illuminates the target surface with the predetermined pattern of light.

In a further embodiment the apparatus further comprises a fixture in which at least one array is disposed.

In yet another embodiment apparatus further comprises a plurality of arrays disposed in the fixture to additively produce the predetermined collective beam which illuminates the target surface with the predetermined pattern of light.

For example, light source has a primary axis around which the predetermined radiation pattern is defined. The intensity of light of the predetermined pattern is defined as a function of an azimuthal angle and polar angle with respect to the primary axis of the light source. The reflector is positioned with respect to the light source, has a curved surface, and has a shaped outline which are selected to substantially control at least one of either the azimuthal or polar angle dependence of the intensity of light of the predetermined pattern. In another embodiment the optic is positioned with respect to the light source so that the shape of the inner and/or outer surfaces of the optic is selected to substantially control at least one of either the azimuthal or polar angle dependence of the intensity of light of the predetermined pattern. When the optic is used to control one of either the azimuthal or polar angle dependence of the intensity of light of the predetermined pattern, the reflector is used to substantially control the other one of either the azimuthal or polar angular dependence of the light intensity of the predetermined pattern. Thus, the reflector and optic can be shaped to each or collectively control either the azimuthal or polar angle dependence of the intensity of light of the predetermined pattern or both in any combination desired.

In an illustrated embodiment outer surface of the optic is shaped to have a smooth surface resistant to the accumulation or collection of dust, dirt, debris or any optically occluding material from the environment.

In one embodiment the reflector comprises a first surface reflector, while in another embodiment the reflector comprises a second surface reflector.

In one embodiment the optic has receiving surfaces defined therein and where the reflector is a reflector mounted into and oriented relative to the light source by the receiving surfaces of the optic. The receiving surfaces of the optic and the reflector have interlocking shaped or mutually aligning portions which are heat staked or fixed together when assembled.

In another one of the illustrated embodiment hemispherical space into which the predetermined beam is directed is defined into a front half hemisphere and a back half hemisphere. The reflector is positioned relative to the light source, curved and provided with an outline such that a majority of the energy of the light in the predetermined radiation pattern is directed by the reflector and/or optic into the front half of the hemisphere. It should be noted that the front-back asymmetry is one embodiment and other such asymmetries are germane to this invention.

The brief description above is primarily a structural definition of various embodiments of the invention, however, embodiments of the invention can also be functionally defined. The illustrated embodiments of the invention include an apparatus for illuminating a target surface with a predetermined pattern of light comprising a light source generating light having a predetermined radiation pattern radiated into a predetermined solid angle having a first and second zone, and reflector means onto which light from the light source is directly incident. The reflector means reflects the directly incident light with a single reflection to form a predetermined reflected beam. Optic means refracts or directs substantially all of the light directly transmitted from the light source into the first zone of the predetermined solid angle of the radiation pattern into a refracted/directed beam. Substantially all of the light in the second zone, which comprises all of the remaining portion of the solid angle of the radiation pattern or the entire radiation pattern, is directly incident on the reflector means from the light source and is reflected by the reflector means into the predetermined reflected beam. The optic means refracts or directs the predetermined reflected beam from the reflector to form a composite beam from the refracted/directed and reflected beams. A composite beam when incident on the target surface forms the predetermined pattern on the target surface.

In other words, in an example embodiment of the invention the light source has a radiation pattern which is completely or substantially intercepted by either the optic or the reflector, and the reflected light from the reflector is then also directed through the optic into a composite beam. However, it is expressly to be understood that the scope of the invention includes embodiments where the light source has a radiation pattern which is only partially intercepted by either the optic or the reflector.

As described above embodiments of the invention include optic means and reflector means which form the composite beam with an azimuthal spread so that the predetermined pattern of light on the target surface has an azimuthal beam spread on the target surface of approximately 45°±15°, approximately 60°±15°, approximately 90°±15°, approximately 120°±15°, approximately 180°±15°, or approximately 270°±15°. The error bar of ±15° has been disclosed as an illustrated embodiment, but it is to be understood that other magnitudes for the error bar for this measure could be equivalently substituted without departing from the scope of the invention.

As described in the embodiments above the light source and reflector means are positioned inside the optic means.

An embodiment includes an optic means which is spatially configured with respect to the light source to directly receive substantially all of the light in the predetermined radiation pattern of the light source other than that portion directly incident on the reflector means, which portion is reflected onto an inner surface of the optic means, so that substantially all of the light in the predetermined radiation pattern, which is not absorbed or misdirected as a result of imperfect optical properties of the optic and reflector, is directed by the optic means into the predetermined beam.

In one embodiment the light source, optic means and reflector means comprise a lighting device, and further comprising a plurality of lighting devices and a carrier, the lighting devices arranged on the carrier to form an array of lighting devices to additively produce a predetermined collective beam which illuminates the target surface with the predetermined pattern of light.

In another embodiment the apparatus further comprises a fixture in which at least one array is disposed.

In still another embodiment the apparatus further comprises a plurality of arrays disposed in the fixture to additively produce the predetermined collective beam which illuminates the target surface with the predetermined pattern of light.

In yet another embodiment the light source has a primary axis around which the predetermined radiation pattern is defined. The intensity of light of the predetermined pattern is defined as a function of an azimuthal angle and polar angle with respect to the primary axis of the light source. The reflector means substantially controls at least one of either the azimuthal or polar angle dependence of the intensity of light of the predetermined pattern.

In another embodiment the optic means substantially controls at least one of either the azimuthal or polar angle dependence of the intensity of light of the predetermined pattern. In this case it is also possible that the reflector means substantially controls the other one of either one of the azimuthal or polar angle dependence of the intensity of light of the predetermined pattern not substantially controlled by the optic means.

In one embodiment the optic means includes an outer surface shaped to have a smooth surface resistant to the accumulation or collection of dust, dirt, debris or any optically occluding material from the environment.

In many example embodiments of the invention the reflector means comprises a first surface reflector, but a second surface reflector is also included within the scope of the invention.

The illustrated embodiments also includes a method for providing an apparatus used with a light source having a predetermined radiation pattern radiated into a predetermined solid angle and used for illuminating a target surface with a predetermined composite pattern of light comprising the steps of providing a reflector onto which light from the light source is incident and which incident light is reflected from the reflector with a single reflection to form a reflection pattern; providing an optic having an inner and outer surface; and disposing the reflector into or next to the optic in an aligned configuration to occupy a portion of the predetermined solid angle around the light source to the exclusion of the optic at least with respect to any optical function to directly receive a second portion of light from the light source, the optic occupying substantially all of the remaining portion of the predetermined solid angle to directly receive a first portion of light from the light source, a reflected beam from the reflector including substantially all of the second portion of light and being reflected into a predetermined reflection pattern, the inner and/or outer surface of the optic being shaped to refract or direct light which is directly transmitted into the optic from the light source from the first portion of light and/or reflected into the optic from the reflector from the reflected beam into a predetermined beam, which when incident on the target surface forms the predetermined composite pattern of light on the target surface.

In the embodiment where the light source has a primary axis around which the predetermined radiation pattern is defined, and where the intensity of light of the predetermined pattern is defined as a function of an azimuthal angle and polar angle with respect to the primary axis of the light source, the reflector means includes a reflective surface having a plurality of subsurfaces with different curvatures in azimuthal and polar directions, and where each of the subsurfaces substantially controls one of either the azimuthal or polar angle dependence of the intensity of light of the predetermined pattern or both.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

Various embodiments of the invention can now be better understood by turning to the following detailed description of the illustrated example embodiments of the invention defined in the claims. It is expressly understood that the invention as defined by the claims may be broader than the illustrated embodiments described below.

DETAILED DESCRIPTION OF EMBODIMENTS OF THE INVENTION

Figure 1:
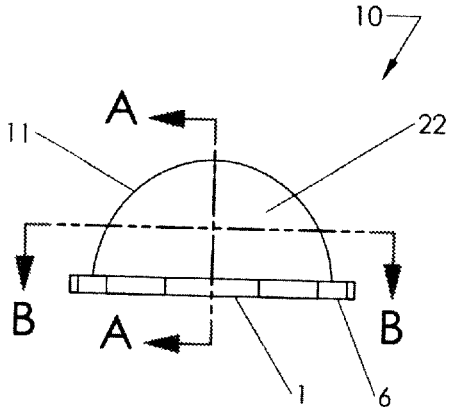
FIG. 1. is a side plan view of an example embodiment of the invention.

FIG. 1 illustrates a side plan view of a device 10 corresponding to a first embodiment of the invention. Device 10 comprises an LED (light emitting diode) or LED package, the base of package 1 of which only is viewable in the view of FIG. 1 and a base 6 to an optical surface 11 of the optic 22, the outer surface 11 of which is shown in FIG. 1 as generally hemispherical. The smooth outer surface 11 of the optic 22 minimizes the amount of dust, dirt or debris that tends to lodge, stick or otherwise adhere to the optic 22, so that when device 10 is used as an exposed light source in a luminaire, it tends to shed environmental borne material that might otherwise obscure or reduce the optical transmissibility of outer surface 11 of the optic 22 over time. Thus, it must be understood that while the embodiment of FIG. 1 shows a substantially hemispherical outer surface 11, it is within the scope of the invention that the outer surface 11 could be provided with other smooth three dimensional shapes which would have selective refractive qualities according to design.

Figure 2:
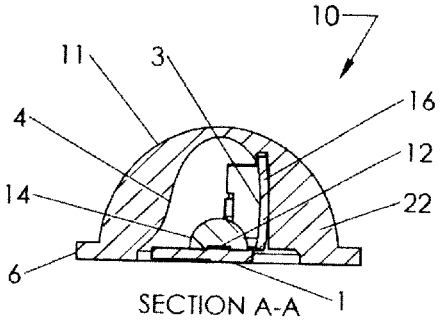
FIG. 2. is a cross-sectional view of the embodiment of the invention shown in FIG. 1 taken through section lines A-A.

FIG. 2. is a cross-sectional view of the embodiment of the invention shown in FIG. 1 taken through section lines A-A. FIG. 2 shows an optic 22 device 10 in side cross sectional view as seen in section lines A-A of FIG. 1 with a reflective surface 3 of a reflector or mirror 16 (hereinafter "reflector")) situated inside the space between the LED package 1 and the optic 22 defined by the inner surface 4 of the optic 22. Whereas a "mirror" is generally understood to be an optic with a reflective surface created by a reflective or aluminized coating or film, the term "reflector" as used in the specification and claims is to be understood as including a mirror, a totally internally reflecting surface, a reflective grating, or any other kind of optical device which reflects light in whole or part. Dome 14 of the LED package 1 is disposed into the cavity or space defined by inner surface 4 in the optic 22. There is an air gap so that inner surface 4 of the optic 22 is a refracting surface which is positioned around dome 14 of the LED package 1. By modifying the interior surface 4 of the optic 22, the ray set from the LED chip or source 12 can be modified to accommodate user-defined system requirements, which may vary from one application to another. In addition the reflective surface 3 of reflector 16 may be selectively curved and sized to provide a ray set with controlled parameters as dictated by the ultimately needed illumination pattern on the target surface. The side cross-sectional view of FIG. 2 shows the reflector 16 to be curved in the longitudinal axis or as a function of the polar angle and also curved azimuthally as best shown in the top cross-sectional view of FIG. 3. In the illustrated embodiment reflective surface 3 is a first surface reflector, namely the innermost surface of reflector 16 is provided with the reflective coating, although use of a second surface reflector is included within the scope of the invention.

Figure 3:
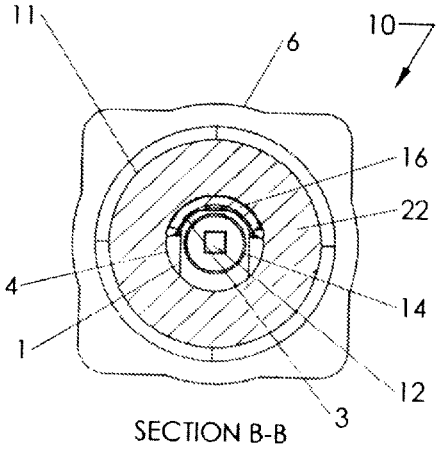
FIG. 3. is a cross-sectional view of the embodiment of the invention shown in FIG. 1 taken through section lines B-B.

FIG. 3. shows an embodiment of the invention where the inner surface 4 of the optic 22 is radially disposed about the centerline of the dome 14 of the LED package 1. Off-center configurations of optic 22 with respect to the centerline of the radiation pattern of the LED package 1 are also contemplated as within the scope of possible design options of the invention. The surface 4 of the optic 22 that is occluded by reflective surface 3 from the light source 12 can be any shape needed for the assembly of the primary elements of the invention. In the embodiment of FIGS. 1-5 the portion of surface 4 occluded by reflector 16 is shaped to provide a supporting and registering surface to support and align reflector 16 in the correct position and angular orientation with respect to light source 12 to obtain the designed net radiation pattern from device 10.

Figure 4:
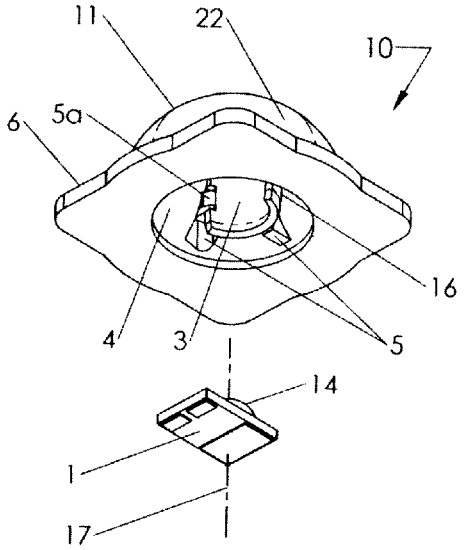
FIG. 4. is a rotated isometric view of the embodiment of the invention shown in FIG. 1.
Figure 5:
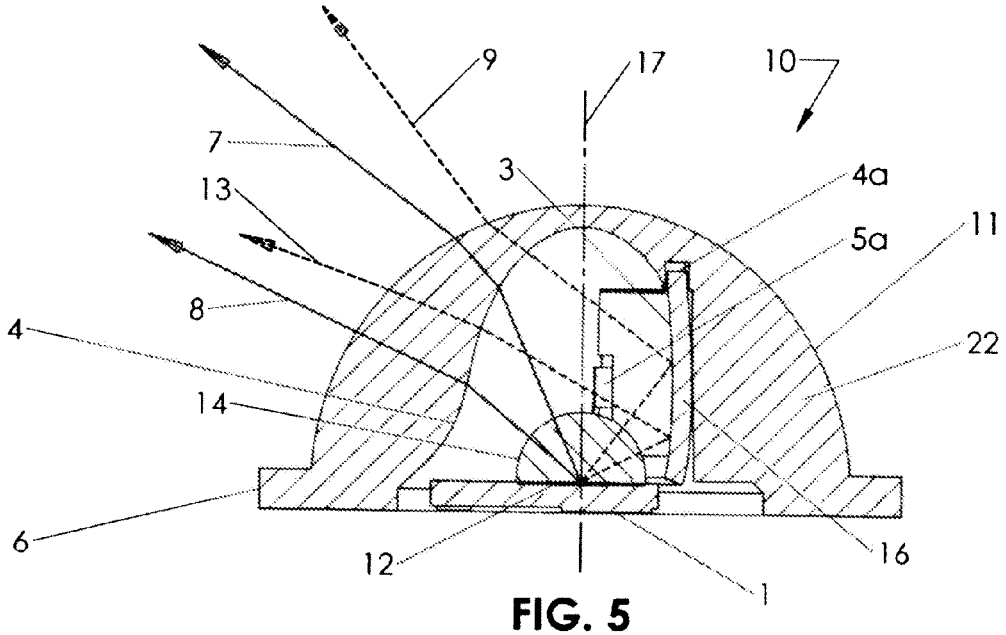
FIG. 5. is an enlarged side cross-sectional view of Section A-A as shown in FIG. 2.

For example, in this embodiment surface 4 has a notch 4*a* defined in it as shown in FIG. 5 into which a post integrally extending from reflector 16 is positioned during assembly. Locating flanges 5 as best seen in FIG. 4 extend from surface 4 to provide a multiple-point guide for the lower curved portion of reflector 16. Side clips 5*a* extend from surface 4 to snap into matching indentations defined in the lower forward edges of reflector 16 as seen in FIGS. 4 and 5. Many different mounting and alignment schemes can be used for the assembly of reflector 16 in the optic 22. An additional embodiment is shown in the second embodiment of FIGS. 7-11*b*, which by no means limits the range of equivalent designs. In FIG. 4. the LED package 1 is vertically removed from the cavity in the optic 22 to show the inside detail of the optic 22. Base flange 6 as shown in FIGS. 1-5 is an optional feature of the optic 22 which is utilized for rotational mounting orientation or angular indexing.

In an alternative embodiment, reflector 16 may be replaced by a specially contoured or curved portion of inner surface 4 which has been metalized or otherwise formed or treated to form a reflective surface in place of the separate reflector 16 for the zone 2 light. Zone 1 and 2 light is further described below in greater detail.

FIG. 5. shows sample rays 7, 8, 9, and 13 radiating from LED light source 12 and propagating through the optic 22. Rays 7 and 8 represent the set of rays that would radiate from the source in a first zone or solid angle (zone 1) and directly refract from or through surfaces 4 and 11 of the optic 22. Directly incident rays 9 and 13 represent the set of rays that would radiate from the light source (e.g., LED) 12 in a second zone or solid angle (zone 2), reflect off reflective surface 3 of the reflector 16 with a single reflection and then refract from or through surfaces 4 and 11 of the optic 22. The optic 22 and reflector 16 are spatially and angularly oriented relative to the radiation pattern of the light source 12 such that substantially all the light from the light source 12 is collected from zone 1 and directly refracted by surfaces 4 and/or 11 or collected in zone 2 and reflected by reflector 16 into refracting surfaces 4 and/or 11 to join the ray set of rays 7 and 8 into the corresponding illumination pattern from the optic 22. Hence, substantially all of the light is collected from the light source 12 and distributed into the beam from the optic 22. The term "substantially" is understood in this context to mean all of the light radiated out of the dome 14 of the LED light source 12 in the intended Lambertian or designed radiation pattern less a fraction of light inherently lost due to imperfect optics or imperfect light sources often due to imperfect refraction, reflection or small imprecision in optical geometries or figure losses.

Figure 6:
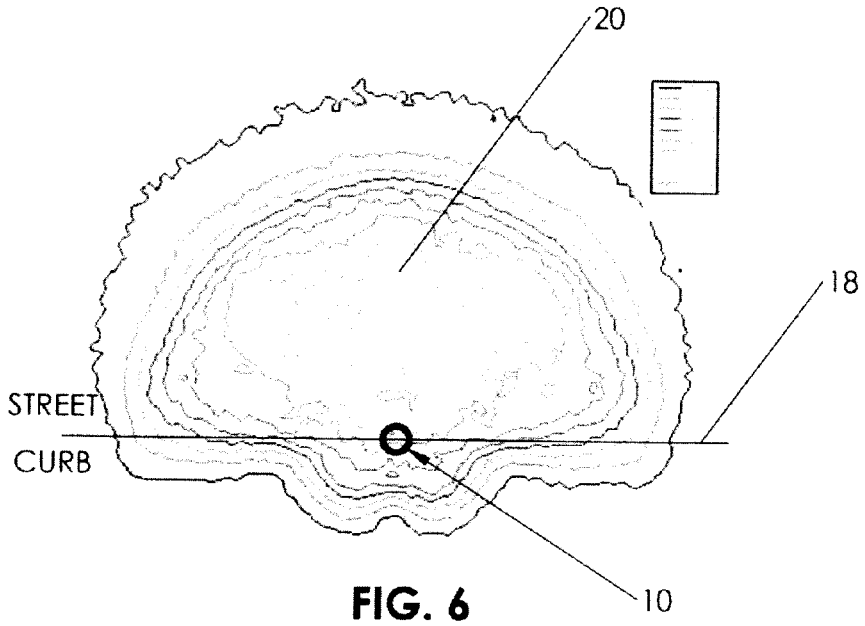
FIG. 6 is a computer generated plot of a two dimensional surface representing a typical iso-foot-candle graph of the embodiment of FIGS. 1-5.

FIG. 6. represents the iso foot-candle illumination pattern of device 10 of the embodiment of FIGS. 1-5. The optic assembly(s) 10 is positioned above the illumined surface, such as a street, most likely as an array or plurality of arrays of such devices 10 mounted in a luminaire or fixture. The illumination pattern is shown by the majority of energy radiating from the device 10 falling on the street side of the surface and a lesser amount falling on the curb side as delineated by artificial horizontal line 18. Varying surfaces 3, 4 and/or 11 in FIGS. 1-5 allows the optic designer to vary or form the resultant energy distribution 20 of the device according to the design specifications, e.g. one of the various patterns meeting IES standards including the Type I-V street lighting patterns.

Optic 22 assembly 10 may be additionally modified by a curved or shaped portion of inner surface 4 to redirect it to a selected portion of outer surface 11 of optic 22 for a user-defined system requirement as may be desired in any given application. For example, it is often the case that the light on or near the vertical axis 17 of LED package 1 (as shown in FIG. 5) needs to be redirected to a different angle with respect to axis 17, namely out of the central beam toward the periphery or toward a selected azimuthal direction. In such a case, inner surface 4 will then have an altered shape in its crown region adjacent or proximate to axis 17 to refract the central axis light from LED package 1 into the desired azimuthal and polar direction or directions. For example, inner surface 4 may be formed such that light incident on a portion of surface 4 lying on one side of an imaginary vertical plane including axis 17 is directed to the opposite side of the imaginary vertical plane.

It is to be expressly understood that the illustrated example of an additional optical effect is not limiting on the scope or spirit of the invention which contemplates all possible optical effects achievable from modification of inner surface 4 alone or in combination with correlated modifications of exterior surface 11 of optic 22. There are a variety of independent design controls available to the designer in the device 10 of the illustrated embodiments. In addition to the design controls discussed below, it is to be understood that the choice of materials for the optical elements is expressly contemplated as another design control, which by no means exhaust the possible range of design controls that may be manipulated. The outer surface 11 of optic 22 may be selectively shaped to independently control either the azimuthal or polar angular distribution of light being refracted or distributed through surface 11. Similarly, the inner surface 4 of optic 22 may be selectively shaped to independently control either the azimuthal or polar angular distribution of light being refracted or distributed through surface 4. Still further, the surface 3 of reflector 16 may be selectively shaped to independently control either the azimuthal or polar angular distribution of light being reflected from surface 3. Each of these six design inputs or parameters can be selectively controlled independently from the others. While in the illustrated embodiments surfaces 3, 4, and 11 are each selectively shaped to control both the azimuthal and polar angular distribution of light from the corresponding surface, it is possible to control only one angular aspect of the light distribution from the surface to the exclusion of either one or both of the other surfaces. For example, it is expressly contemplated that it is within the scope of the invention that the azimuthal distribution of the refracted portion or zone 1 portion of the beam can be entirely or substantially controlled only by the outer surface 11 while the polar distribution of the zone 1 portion of the beam will be entirely or substantially controlled only by the inner surface 4, or vice versa. It is also contemplated that the azimuthal spread and amount of the illumination beam derived from the zone 2 light can be controlled with respect to the zone 2 light by the curvature and outline of the reflector 16 and its distance from the light source 12. Similarly, the reflector 16 can be used to entirely or substantially control the azimuthal or polar distribution of the reflected beam or control both the azimuthal and polar distributions of the reflected beam.

Consider now the second embodiment of FIGS. 7-12. The same elements are referenced by the same reference numerals and incorporate the same features and aspects as described above. The illustrated embodiment is denoted by the applicant as "blob optics" incorporated into device 10 of FIGS. 7-11*b*, combined with any one of a plurality of commercially available LED package(s) 1. By the term "blob optic" is a type of optic where it is meant that the refracting surface is free-form in design and is particularly characterized by refracting surfaces that form positively or negatively defined lobes in surfaces 4 and/or 11 with respect to surrounding portions of the optical surfaces. Thus, it is to be clearly understood that a "blob optic" is but one type of optic that may be employed in the embodiments of the invention. In the illustrated embodiment of FIGS. 7-11*b*, the lobes are defined positively in the outer surface 11 of the optic 22, while the inner surface 4 of the optic 22 remains substantially hemispherical. However, it is expressly contemplated that portions of inner surface 4 may also either be smoothly flattened or lobed to provide selectively refractive local surfaces in addition to refractive lobed cavities defined on outer surface 11.

One way in which the notion of positively or negatively defined lobes may be visualized or defined is that if an imaginary spherical surface where placed into contact with a portion of a refracting surface, that portion of the refracting surface most substantially departing from the spherical surface would define the lobe. The lobe would be positively defined if defined on the surface 4 or 11 so that the optical material of the optic 22 extended in the volume of the lobe beyond the imaginary spherical surface, or negatively defined if defined into the surface 4 or 11 so that an empty space or cavity were defined into the optical material of the optic 22 beyond the imaginary spherical surface. Thus, it must be understood that lobes can be locally formed on or into the inner or outer surfaces 4, 11 of the optic 22 in multiple locations and extending in multiple directions. The design of lobed optics is further disclosed in copending application Ser. No. 11/711,218, filed on Feb. 26, 2007, assigned to the same assignee of present application, which copending application is hereby incorporated by reference.

Figure 8:
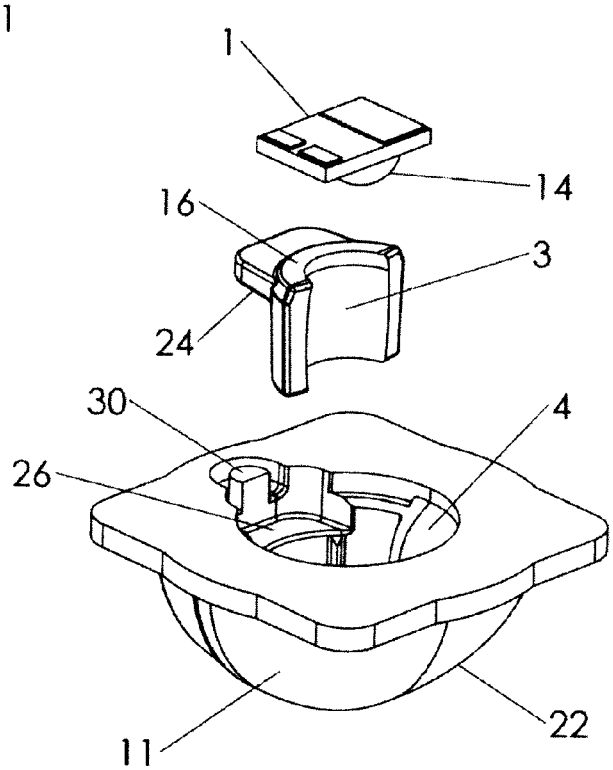
FIG. 8 is bottom perspective view of the second embodiment of the invention of FIG. 7 shown in exploded view.
Figure 9A:
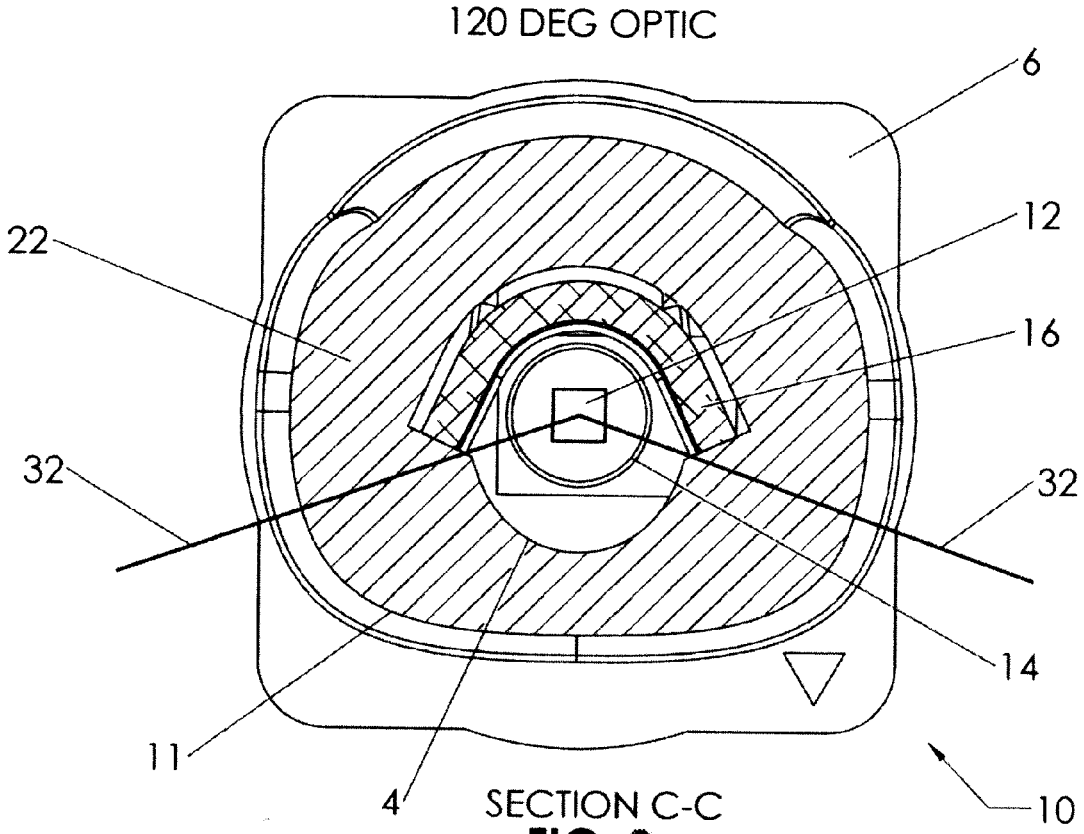
FIG. 9*a* is a top cross-sectional view of an embodiment of the invention for providing an approximately 120° azimuthally spread beam as seen through the section lines C-C of FIG. 9*b*.
Figure 9B:
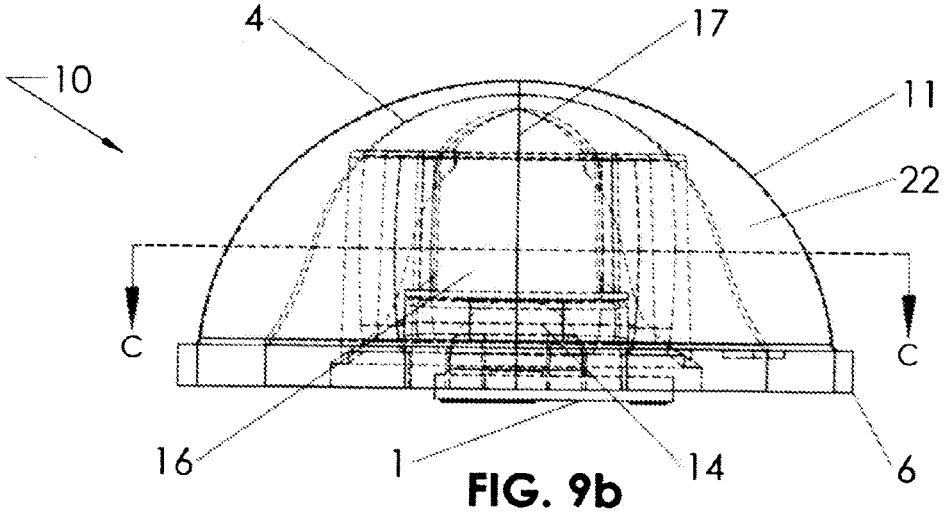
FIG. 9*b* is a side plan view of the embodiment of the invention of FIG. 9*a* with underlying structures shown in dotted outline.

In the second embodiment reflector 16 again is entirely housed inside of optic 22 within the cavity defined by inner surface 4. Reflector 16 is integrally provided with a basal flange 24 extending rearwardly. The basal flange 24 flatly mates onto a shoulder 26 defined in surface 4, as seen in FIG. 8, which serves both to position and orient reflector 16 in the designed configuration. In this embodiment there is no notch in the crown of optic 22, nor is there a post extending from reflector 16. Flange 24 integrally extends rearwardly from reflector 16 to flushly fit onto shoulder 26 of optic 22 adjacent to rivet post 30. Rivet post 30 is heat staked during assembly to soften and deform over the bottom surface of flange 24 to effectively form a rivet post head which fixes reflector 16 into the position and orientation defined for it by flange 24 and mating shoulder 26.

FIGS. 9*a*-11*b* illustrate various embodiments where the beam spread of the illumination pattern is varied. The embodiment of FIGS. 9*a* and 9*b* define a device 10 of the type shown in FIGS. 7 and 8 in which the azimuthal beam spread produced by surfaces 4 and 11 and reflector 16 include an azimuthal angle of approximately 120°. The azimuthal angular spread of the illumination pattern on the ground need not be exactly 120° but may vary ±15° or more from that normal azimuthal spread. In the top cross-sectional view of FIG. 9*a* as seen through section C-C of FIG. 9*b* imaginary beam spread edges 32 are shown extended from the center of light source 12, touching the forward extremity of the reflective surface 3 of reflector 16 to form the spread angle, shown as being of the order of 120°. Clearly, the outline of reflector 16 need not be uniform in the vertical axis so that greater or lesser angular segments of the zone 2 from light source 12 may impinge on the reflective surface 3.

Figure 7:
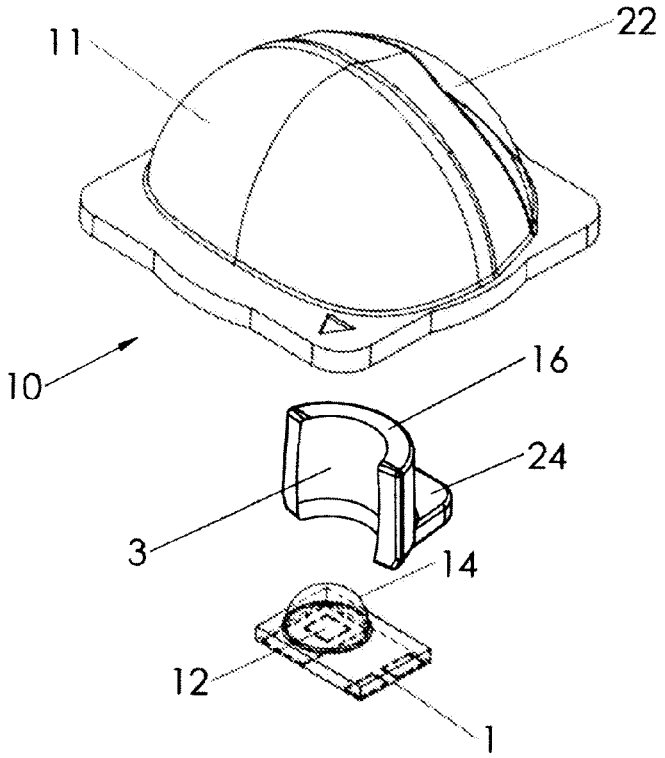
FIG. 7 is top perspective view of a second embodiment of the invention shown in exploded view.
Figure 10A:
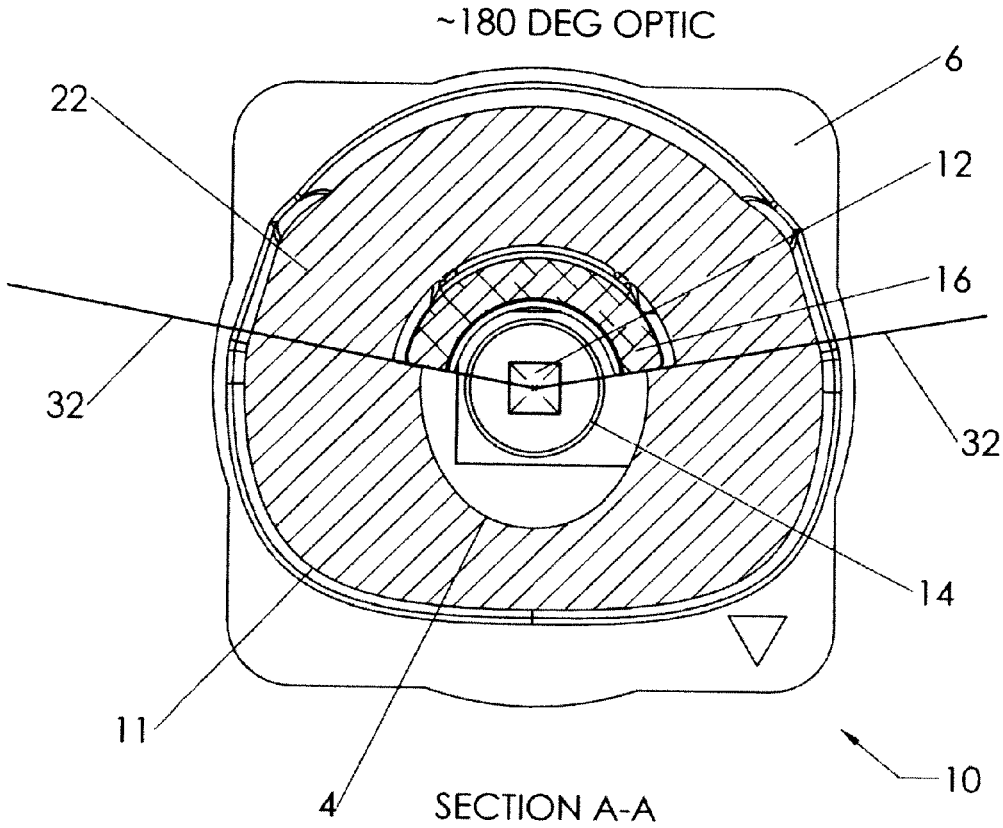
FIG. 10*a* is a top cross-sectional view of an embodiment of the invention for providing an approximately 180° azimuthally spread beam as seen through the section lines A-A of FIG. 10*b*.
Figure 10B:
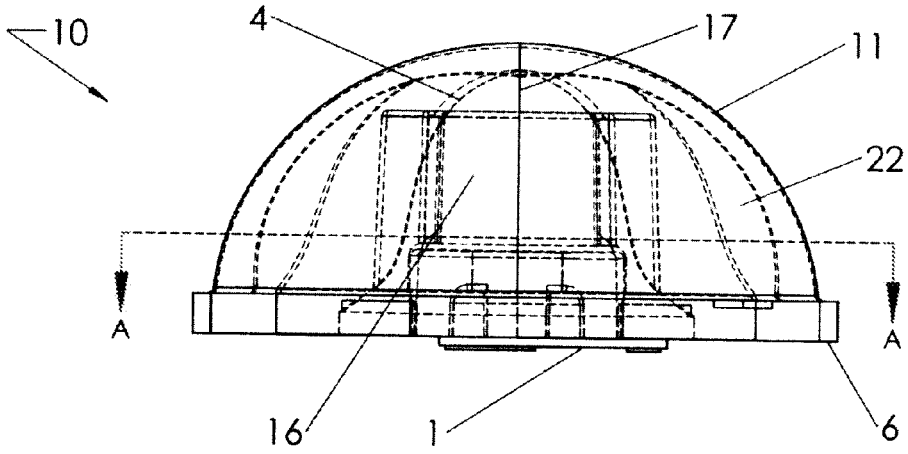
FIG. 10*b* is a side plan view of the embodiment of the invention of FIG. 10*a* with underlying structures shown in dotted outline.

The embodiment of FIGS. 10*a* and 10*b* define a device 10 of the type shown in FIGS. 7 and 8 in which the azimuthal beam spread produced by surfaces 4 and 11 and reflector 16 include an azimuthal angle of approximately 180°. Again, the azimuthal angular spread of the illumination pattern on the ground need not be exactly 180° but may vary ±15° or more from that normal azimuthal spread. In the top cross-sectional view of FIG. 10*a* as seen through section A-A of FIG. 10*b* imaginary beam spread edges 32 are shown extended from the center of light source 12, touching the forward extremity of the reflective surface 3 of reflector 16 to form the spread angle, shown as being of the order of 180° or, in the illustrated embodiment, somewhat in excess of 180°. In the expected application of a luminaire including device 10, it will be mounted on a pole or fixture which extends some distance away from the building to which it is mounted or, in the case of a street light, away from the pole on which the luminaire is mounted. For this reason the illumination pattern on the ground or street has an azimuthal spread with respect to nadir of more than 180° to include a portion of the illumination pattern extending back to the building or to the curb as shown in the iso-foot-candle plot of FIG. 6.

In the same manner the other embodiments like those of FIGS. 9*a*, 9*b*, 11*a* and 11*b* may be increased or decreased from the nominal designed azimuthal angular spread. Again, the outline of reflector 16 need not be uniform in the vertical axis so that greater or lesser angular segments of the zone 2 from light source 12 may impinge on the reflective surface 3, and the azimuthal beam spread may be a selectively chosen function of the vertical distance about the base of optic 22.

Figure 11A:
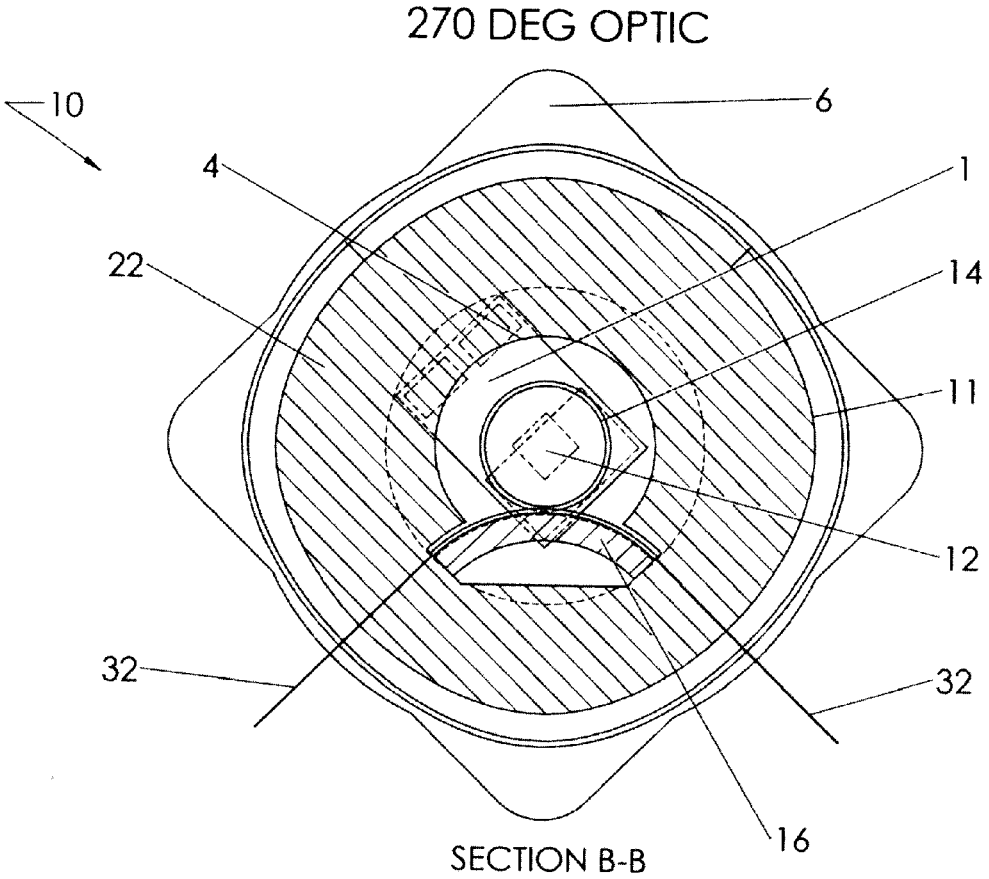
FIG. 11*a* is a top cross-sectional view of an embodiment of the invention for providing an approximately 270° azimuthally spread beam as seen through the section lines B-B of FIG. 11*b*.
Figure 11B:
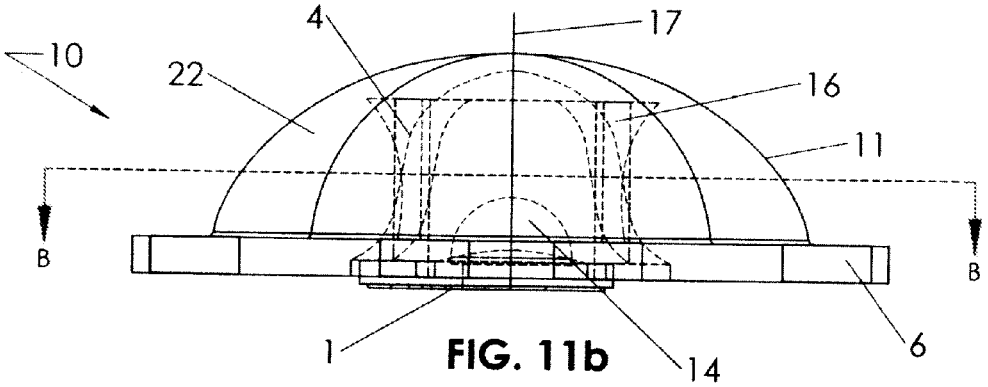
FIG. 11*b* is a side plan view of the embodiment of the invention of FIG. 11*a* with underlying structures shown in dotted outline.

The embodiment of FIGS. 11*a* and 11*b* define a device 10 of the type shown in FIGS. 7 and 8 in which the azimuthal beam spread produced by surfaces 4 and 11 and reflector 16 include an azimuthal angle of approximately 270°. Again, the azimuthal angular spread of the illumination pattern on the ground need not be exactly 270° but may vary ±15° or more from that normal azimuthal spread. In the top cross-sectional view of FIG. 11*a* as seen through section B-B of FIG. 11*b* imaginary beam spread edges 32 are shown extended from the center of light source 12, touching the forward extremity of the reflective surface 3 of reflector 16 to form the spread angle, shown as being of the order of 270°. Again, the outline of reflector 16 need not be uniform in the vertical axis so that greater or lesser angular segments of the zone 2 from light source 12 may impinge on the reflective surface 3, and the azimuthal beam spread may be a selectively chosen function of the vertical distance about the base of optic 22. In the illustrated embodiment, reflector 16 of FIGS. 11*a* and 11*b* is a saddle-shaped reflector with a concave surface facing toward light source 12 defined along its vertical axis as seen in dotted outline in FIG. 11*b* and a convex surface facing toward light source 12 defined along its horizontal axis as seen in section B-B in FIG. 11*a*.

In the same manner as illustrated in FIGS. 9*a*-11*b*, an embodiment may be provided according to the teachings of the invention to provide a device 10 with an azimuthal beam spread of the order of 90°±15° or more or any other angular spread as may be needed by the application.

Figure 12:
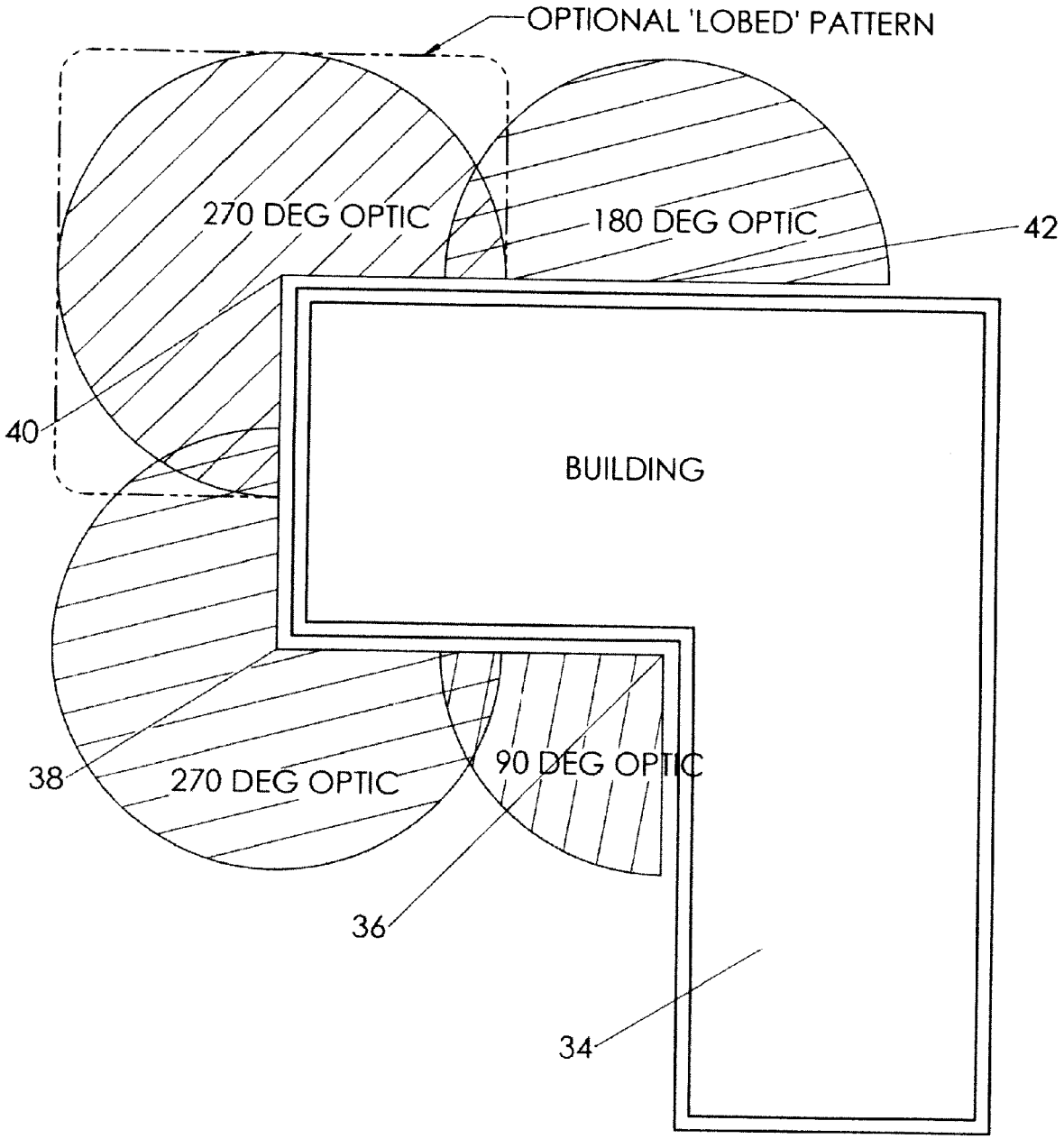
FIG. 12 is a schematic plan view of a building footprint in which azimuthally spread beam luminaires are provided in various positions of the building outline to provide for approximately 270°, 180° and 90° illumination ground patterns using various embodiments of the invention.

FIG. 12 illustrates one application where such varied beam spread devices 10 may be advantageously employed. The footprint of an L-shaped building 34 is shown. At different points in the building perimeter or footprint lights with different azimuthal spreads are required to provide efficient and effective ground illumination. For example, at the inside corner 36 a 90° device 10 can efficiently illuminate the adjacent ground surface with minimal wasted light energy being expended on walls or portions of the roof which have no need for illumination. Outside corners 38 and 40 advantageously employ a device 10 with a 270° spread to cover the proximate ground areas to these corners of the building, again with minimal wasted light energy being thrown onto walls or other surfaces which require no illumination. Position 42 along a long flat wall of building 34, where there may be a door or walkway, is advantageously provided with a device 10 with a 180° beam spread, again with minimal wasted illumination energy. Using conventional 360° lighting fixtures at these same points, the energy of nearly two additional light sources, as compared to the embodiment of FIG. 12, is wasted by being directed onto surfaces for which illumination is not usefully employed. The use of directional fixtures or angulations to achieve the pattern distribution of FIG. 12 is so complex or expensive that, in general, it is impractical and no attempt is made to direct substantially all of the light from the sources to just those areas where it is needed. It can thus be appreciated that the number of LEDs incorporated into the arrays 60 or luminaires 62 of the invention can also be varied to match the beam spread so that the light intensity or energy on the ground is uniform for each embodiment. In other words, the 90° light at position 36 could have one third the number of LEDs in it than the 270° light at points 38 and 40 and half as many LEDs in it as the 180° light used at position 42. The light intensity patterns on the ground from each of the points would be similar or equal, but the energy would be provided by the luminaires used at each position to efficiently match the application which it was intended to serve.

Position 40 is illustrated in a first embodiment in solid outline as having an idealized three-quarter or 270° circular ground pattern. An optional squared ground pattern is illustrated in dotted outline in FIG. 12 for a lobed device 10. In other words, device 10 used at position 40 would comprise an optic 22 which would have three lobes defined in the inner and/or outer surfaces of the optic 22 to provide a three-cornered or 270° squared ground pattern. The lobes may be defined in inner surface 4 and include one lobe on a centerline aligned with reflector 16 and two symmetrically disposed side lobes lying on a line perpendicular to the centerline. While the shape of inner surface 4 and reflector 16 would be azimuthally asymmetric, device 10 would have reflector symmetry across the centerline plane.

Table 1 below summarizes the architectural beam spreads described above including others, but by no means exhaust the embodiments in the invention may be employed.

| Approximate angle subtended by the mirror in degrees | Nominal or approximate azimuthal beam spread in degrees on target surface |
|---|---|
| More than 0 | Less than 360 |
| 45 | 315 |
| 60 | 300 |
| 90 | 270 |
| 120 | 240 |
| 180 | 180 |
| 240 | 120 |
| 250 | 90 |
| 300 | 60 |
| 315 | 45 |
| 330 | 30 |

Figure 14:
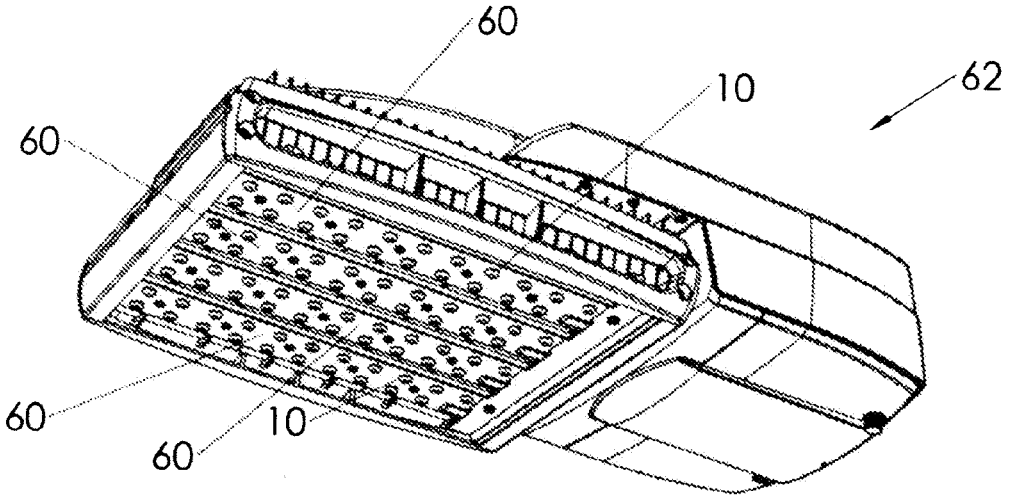
FIG. 14 is a perspective view of a luminaire using the devices of the invention.
Figure 13:
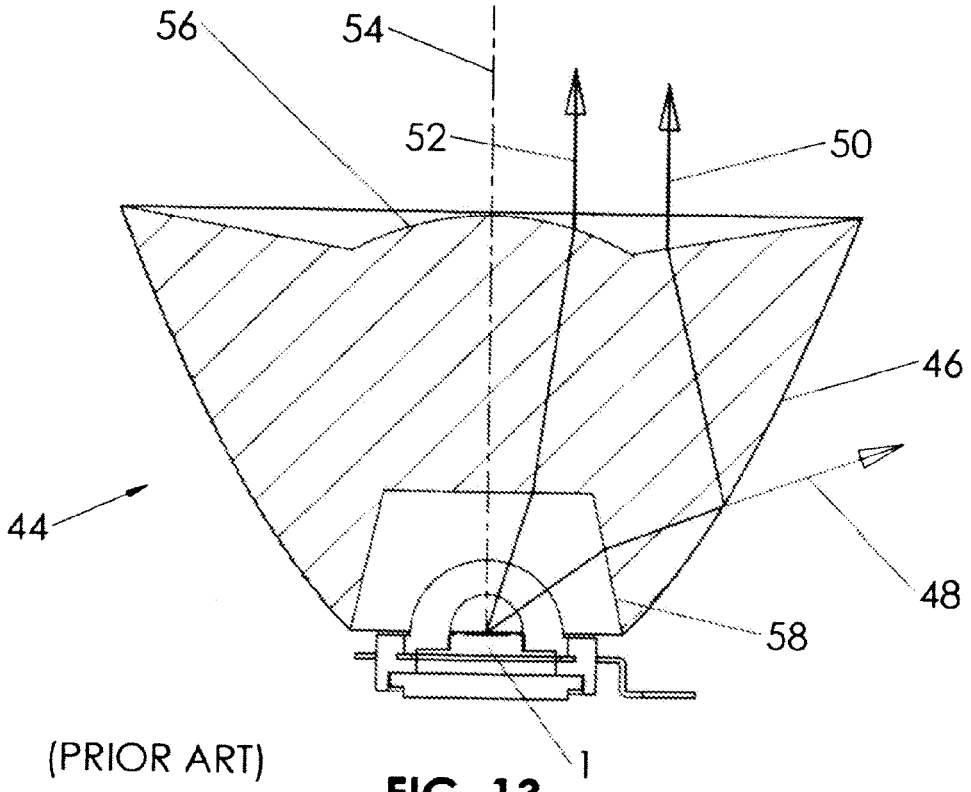
(PRIOR ART) FIG. 13
FIG. 13 is a side cross-sectional view of a prior art TIR optic.
Figure 15:
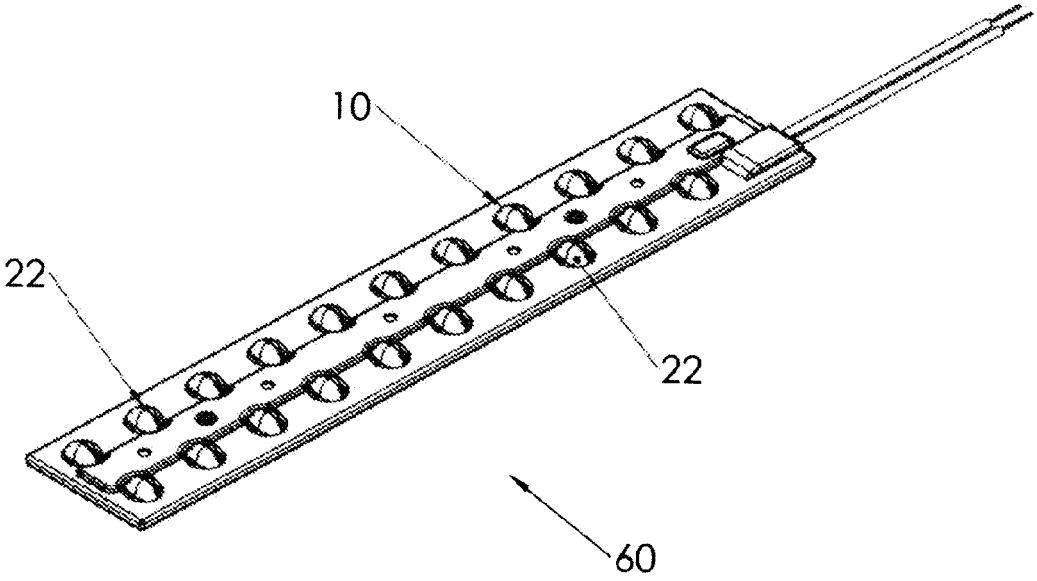
FIG. 15 is a perspective view of an assembled array using the devices of the invention.

An illustration of the arrays 60 and luminaires 62 incorporating devices 10 is shown in FIGS. 14 and 15. A plurality of such arrays 60, each provided with a plurality of oriented devices 10, are assembled into a fixture or luminaire 62 as depicted in one embodiment shown in FIG. 14. Additional conventional heat sinking elements may be included and thermally coupled to a circuit board included in array 60 and light sources 1. In one embodiment of the invention the plurality of optics 22 are left exposed to the environment to avoid any loss or degradation of optical performance over time that might arise from the deterioration or obscuring by environmental factors of any protective transparent covering. However, it is within the scope of the invention that a cover, bezel or other covering could be included. The sealing and weatherproofing of devices 10 as described above in connection with the assembly of arrays 60 allows for the possibility of environmental exposure of optics 22 along with the dust, dirt and debris shedding smooth shape of exposed outer surfaces 11 of optics 22. Luminaire 62 then, in turn, is coupled to a pole or other mounting structure to function as a pathway or street light or other type of illumination device for a target surface.

Figure 16:
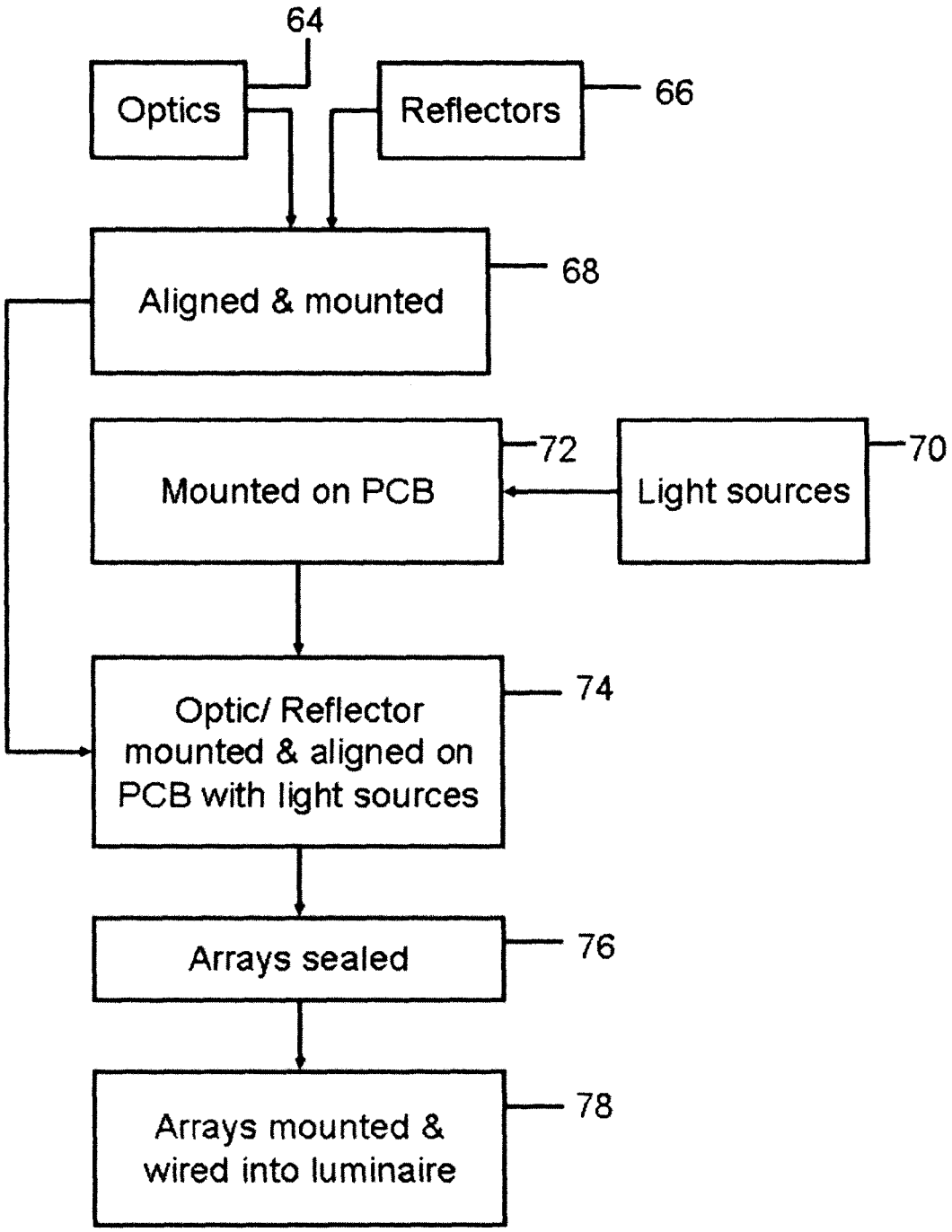
FIG. 16 is a flow diagram showing the assembly of the device including the light source, reflector, and optic into an array and luminaire.

An idealized flow diagram of the assembly of luminaire 62 is illustrated in FIG. 16. Reflectors 16 provided at step 66 are mounted and aligned at step 68 into optics 22 provided at step 64. Light sources 12 are provided at step 70 and aligned to, mounted on or into a printed circuit board and electrically to corresponding drivers and wiring at step 72. The optics/reflectors 16, 22 from step 68 are then aligned and mounted onto the printed circuit board at step 74 to form a partially completed array 60. The array 60 is then finished or sealed for weatherproofing and mechanical integrity at step 76. The finished array 60 is then mounted into, onto and wired into a luminaire 62 at step 78.

Many alterations and modifications may be made by those having ordinary skill in the art without departing from the spirit and scope of the invention. Therefore, it must be understood that the illustrated embodiments described above have been set forth only for the purposes of providing examples and should not be taken as limiting the invention as defined by the following claims.

For example, notwithstanding the fact that the elements of a claim are set forth below in a certain combination, it must be expressly understood that the invention may include other combinations of fewer, more or different elements, which are disclosed above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

We claim:

1. A luminaire comprising:

a housing comprising an area that is operative to emit light towards an area to be illuminated; and a plurality of arrays of light sources, each array mounted to a respective substrate, the substrates mounted adjacent one another at the area of the housing, wherein each light source comprises:

at least one light emitting diode;

an optic covering the at least one light emitting diode and comprising:

a base that extends peripherally with respect to the at least one light emitting diode and that is flat in a first dimension and in a second dimension, the first and second dimensions perpendicular to one another; and an environmentally exposed exterior surface that protects the at least one light emitting diode from environmental exposure and that has a debris shedding smooth shape, the debris shedding smooth shape adjoining the base, extending peripherally about the at least one light emitting diode, and extending fully over the at least one light emitting diode in the first dimension and in the second dimension to cover the at least one diode fully, wherein the debris shedding smooth shape is free from projections and abrupt changes in form to provide a smooth surface resistant to accumulation or collection of dust, dirt, debris, or optically occluding material from an environment; and a mirror disposed between the environmentally exposed exterior surface and the at least one light emitting diode.

2. The luminaire of claim 1, wherein each array is individually weatherproofed.

3. The luminaire of claim 1, wherein fins that are operative to dissipate heat are attached to the housing, wherein the fins are disposed behind the plurality of arrays and project in a first direction, and wherein the arrays of light sources emit light in a second direction that is substantially opposite the first direction.

4. The luminaire of claim 1, wherein the luminaire comprises a street light.

5. The luminaire of claim 1, wherein the at least one light emitting diode is disposed at least partially in a cavity of the optic, and wherein the mirror is disposed in the cavity.

6. The luminaire of claim 1, wherein the optic comprises a cavity that is oriented to receive light rays from the at least one light emitting diode, and wherein substantially all of the light rays that are incident on the mirror are subsequently incident on a surface of the cavity.

7. The luminaire of claim 1, wherein the optic comprises a cavity that is oriented to receive light rays from the at least one light emitting diode, and wherein the mirror is oriented to reflect across the cavity substantially all of said light rays that are incident on the mirror.

8. The luminaire of claim 1, wherein the at least one light emitting diode comprises an axis, a portion of the axis disposed between the at least one light emitting diode and the exterior surface, and wherein the mirror is operative to form a beam that crosses the portion of the axis.

9. The luminaire of claim 1, wherein the environmentally exposed exterior surface that protects the at least one light emitting diode from environmental exposure and that has a debris shedding smooth shape is convex.

10. The luminaire of claim 1, wherein the debris shedding smooth shape is convex.

11. The luminaire of claim 1, wherein the debris shedding smooth shape is substantially hemispherical.

12. A luminaire comprising:

a housing comprising an area that is operative to emit light towards an area to be illuminated; and a plurality of arrays of light sources, each array mounted to a respective substrate, the substrates mounted adjacent one another at the area of the housing, wherein each light source comprises:

at least one light emitting diode;

an optic comprising:

a cavity oriented to receive light from the at least one light emitting diode;

a base that extends peripherally about the cavity and that comprises a first base portion, and second base portion, a third base portion, and fourth base portion, wherein the first base portion and the second base portion are disposed on opposing sides of the cavity along a first reference line, and wherein the third base portion and the fourth base portions are disposed on other opposing sides of the cavity along a second reference line that is perpendicular to the first reference line; and a refractive outer surface that is opposite the cavity, that is operative to emit the received light, that is configured for exposure to an outdoor environment, and that covers the at least one light emitting diode with a debris shedding smooth shape that is free from projections, wherein the debris shedding smooth shape extends from the first base portion to the second base portion, wherein the debris shedding smooth shape extends from the third base portion to the fourth base portion, and wherein the debris shedding smooth shape is smooth to resist accumulation or collection of dust, dirt, debris, or optically occluding material from the outdoor environment; and a reflector disposed in the cavity and oriented to direct onto a surface of the cavity substantially all rays emitted from the at least one light emitting diode that are incident on the reflector.

13. The luminaire of claim 12, wherein the reflector is operative to form from the incident rays a beam that transmits across an axis of the at least one light emitting diode prior to emission from the optic.

14. The luminaire of claim 12, wherein the at least one light emitting diode is intersected by a reference plane that is substantially perpendicular to the substrate associated therewith, wherein the reflector is disposed on a first side of the reference plane, and wherein the reflector is operative to form a beam that passes through a region of the refractive outer surface that is disposed on a second side of the reference plane.

15. The luminaire of claim 12, wherein the at least one light emitting diode is intersected by a reference plane that is substantially perpendicular to one of the substrates;

wherein the reflector is disposed on a first side of the reference plane, and wherein the reflector is operative to form a beam that is incident on a portion of the surface that is disposed on a second side of the reference plane.

16. The luminaire of claim 12, wherein the housing comprises fins extending from the area that are operative to dissipate heat generated by operating the plurality of arrays of light sources.

17. The luminaire of claim 12, wherein the at least one light emitting diode comprises at least one light emitting diode package.

18. The luminaire of claim 12, wherein the at least one light emitting diode has an axis, and wherein the reflector is operative to direct said incident rays across a portion of the axis that is inside the cavity.

19. The luminaire of claim 12, wherein the debris shedding smooth shape is substantially hemispherical.

* * * * *